US006627861B2

(12) United States Patent
Yang

(10) Patent No.: US 6,627,861 B2
(45) Date of Patent: Sep. 30, 2003

(54) THERMOCONDUCTIVE RUBBER PATCH

(76) Inventor: Sheng-Chung Yang, No. 3, Cheng Kung I Rd., Ping Shan Li, Nan Tou City (TW)

( * ) Notice: Subject to any disclaimer, the term of this patent is extended or adjusted under 35 U.S.C. 154(b) by 0 days.

(21) Appl. No.: 09/902,978

(22) Filed: Jul. 11, 2001

(65) Prior Publication Data

US 2003/0010774 A1 Jan. 16, 2003

(51) Int. Cl.[7] ..... H05B 3/34

(52) U.S. Cl. ..... 219/549; 219/529; 219/212; 219/548; 219/553; 219/543

(58) Field of Search ..... 219/529, 528, 219/544, 545, 211, 212, 548, 549, 527, 542, 553, 543

(56) References Cited

U.S. PATENT DOCUMENTS 4,534,886 A * 8/1985 Kraus et al. ..... 252/502
4,833,305 A * 5/1989 Mashimo et al. ..... 219/549
5,023,433 A * 6/1991 Gordon ..... 219/548
5,349,423 A * 9/1994 Nagato et al. ..... 355/285
6,229,123 B1 * 5/2001 Kochman et al. ..... 219/549

* cited by examiner

*Primary Examiner*—Teresa Walberg
*Assistant Examiner*—Shawntina Fuqua

(57) ABSTRACT

A thermoconductive rubber patch includes a thermoconductive rubber piece which is encased by an insulating casing and is made of rubber, carbon black granules and metal granules. The thermoconductive rubber piece is provided with an electric circuit and is capable of generating heat at the time when an electric current flows over the electric circuit. The thermoconductive rubber piece has a resistance, with the magnitude of the resistance being dependent on a ratio by which the carbon black granules and the metal granules are contained in the thermoconductive rubber piece.

1 Claim, 3 Drawing Sheets

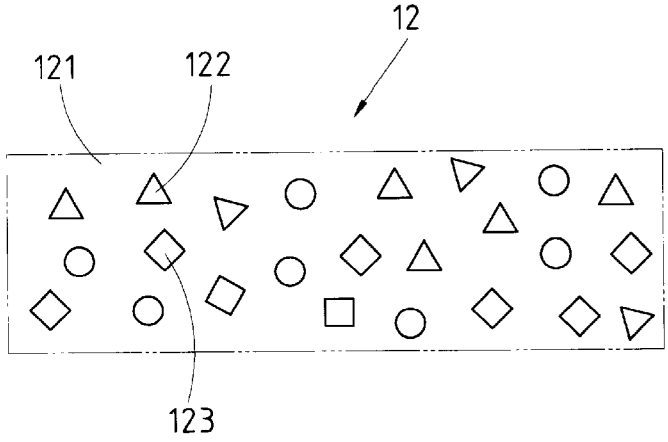
FIG.2-A
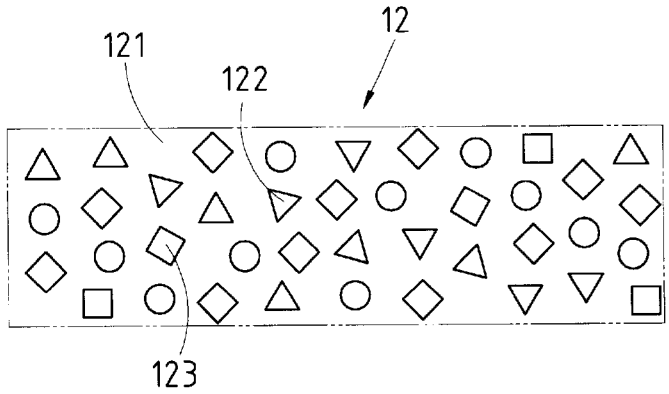
FIG.2-B
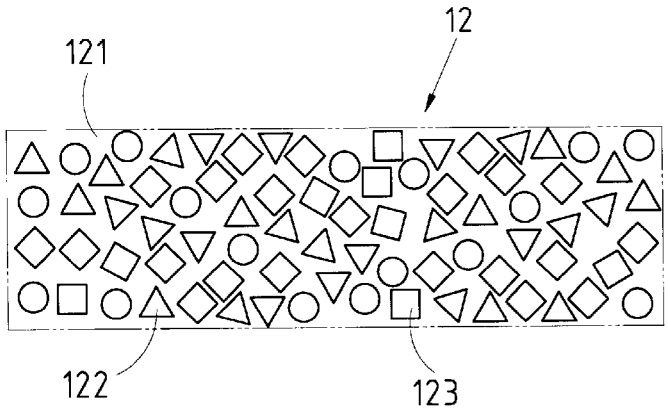
FIG.2-C

THERMOCONDUCTIVE RUBBER PATCH

BACKGROUND OF THE INVENTION

1. Field of the Invention

The present invention relates generally to a thermoconductive rubber material, and more particularly to a thermoconductive rubber patch capable of providing and keeping heat.

2. Description of Related Art

Conventional heating devices are not always suitable for use in a variety of situations. For example, a space heater is designed for use in warming the air of a single confined area. However, the space heater is not suitable for use in the outdoors. In fact, there is currently lack of a material which is capable of providing and keeping heat and capable of being easily carried around or stored without taking up too much space.

BRIEF SUMMARY OF THE INVENTION

The primary objective of the present invention is to provide a thermoconductive rubber patch capable of providing and keeping heat.

In keeping with the principle of the present invention, the foregoing objective of the present invention is attained by the thermoconductive rubber patch comprising an insulating casing, and a thermoconductive rubber piece which is encased by the insulating casing and is made of rubber, carbon black granules, and metal granules. The thermoconductive rubber piece is provided with an electric circuit over which an electric current flows. The thermoconductive rubber piece serves as a resistance to bring about the generation of heat.

The features and functions of the present invention will be more readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIGS. 2A, 2B and 2C are schematic views showing that three thermoconductive rubber pieces of the preferred embodiments of the present invention vary in terms of ratio of carbon black and metal.

DETAILED DESCRIPTION OF THE INVENTION

Figure 1:
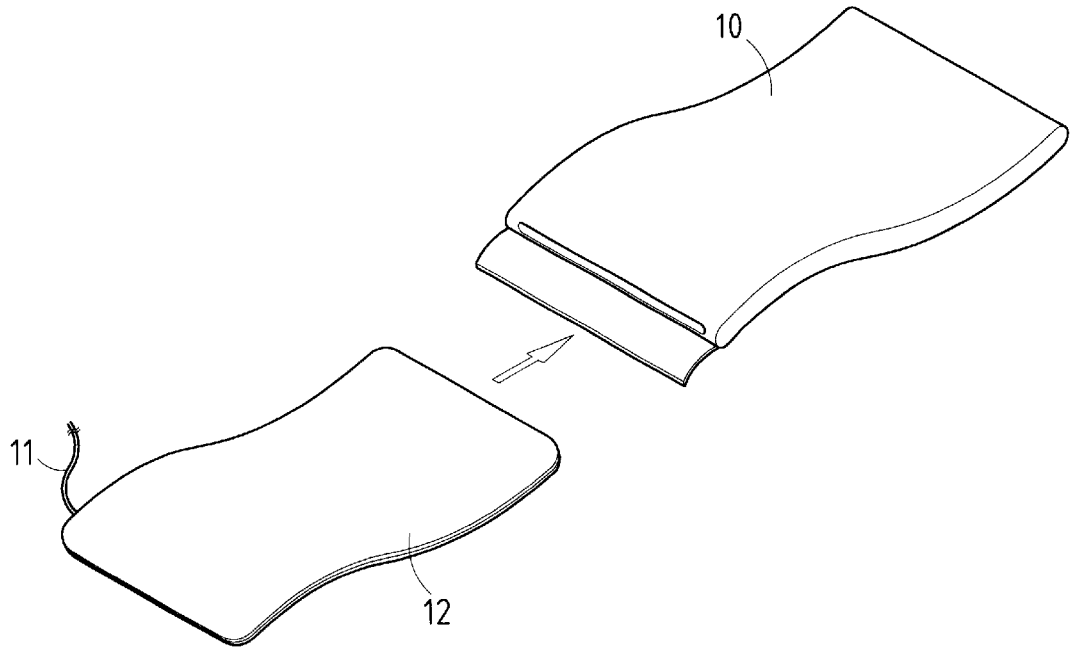
FIG. 1 shows an exploded view of the preferred embodiment of the present invention.

As shown in all drawings provided herewith, a thermoconductive rubber piece of the preferred embodiment of the present invention comprises an insulation casing 10, and a thermoconductive rubber piece 12 which is provided with an electric circuit 11 and is encased by the insulating casing 10. When an electric current flows over the electric circuit 11, the thermoconductive rubber piece 12 acts as a resistance to bring about the generation of heat.

The thermoconductive rubber piece 12 is made of a rubber material 121, a predetermined amount of carbon black granules 122, and a predetermined amount of metal granules 123, as illustrated in FIGS. 2A, 2B, and 2C.

Depending on the amounts of the carbon black granules 122 and the metal granules 123, the resistance of the thermoconductive rubber piece 12 can be changed to result in generation of heat of a desired temperature. For example, a reduction in quantity of the carbon black granules 122 and the metal granules 123 results in a corresponding reduction in resistance of the thermoconductive rubber piece 12. As a result, the heat generated by the thermoconductive rubber piece 12 is reduced. On the other hand, a greater heat is generated by the thermoconductive rubber piece 12 as a result of an increase in quantity of the carbon black granules 122 and the metal granules 123.

Figure 3:
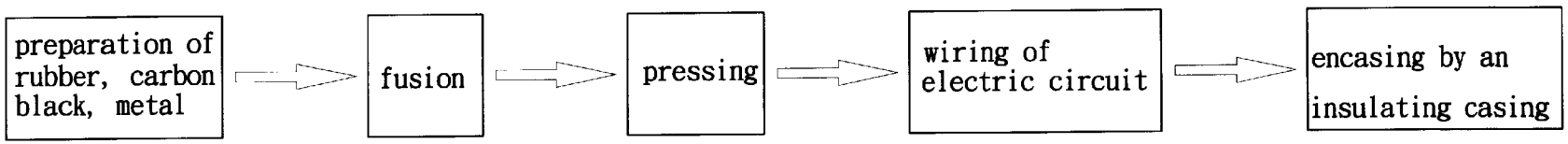
FIG. 3 is a diagrammatic illustration showing a process flow of the preferred embodiment of the present invention.

As illustrated in FIG. 3, the manufacturing process of the preferred embodiment of the present invention involves a first step in which the rubber material 121, the carbon black granules 122, and the metal granules 123 are prepared and joined together by fusion. The intermediate product so made is then made to take a specific form by pressing before it is provided with the electric circuit 11, thereby resulting in production of the thermoconductive rubber piece 12. Finally, the thermoconductive rubber piece 12 is encased by the insulating casing 10. The electric circuit 11 can be externally connected with a power source.

The preferred embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A thermoconductive rubber patch comprising:

an insulating casing; and a thermoconductive rubber piece having an electric circuit embedded therein, said thermoconductive rubber piece being encased by said insulating casing whereby said thermoconductive rubber piece has resistance for generating heat of a predetermined temperature when an electric current flows over said electric circuit, said thermoconductive rubber piece being formed of a rubber material with carbon black granules and metal granules distributed intimately therein in a non-layered arrangement devoid of fibrous material.

* * * * *